US009232880B2

(12) United States Patent
Bosses

(10) Patent No.: US 9,232,880 B2
(45) Date of Patent: Jan. 12, 2016

(54) VACUUM BAG ATTACHMENT ASSEMBLY

(75) Inventor: Mark D. Bosses, Boca Raton, FL (US)

(73) Assignee: Zenith Technologies, LLC, Boca Raton, FL (US)

( * ) Notice: Subject to any disclaimer, the term of this patent is extended or adjusted under 35 U.S.C. 154(b) by 702 days.

(21) Appl. No.: 13/485,256

(22) Filed: May 31, 2012

(65) Prior Publication Data

US 2012/0304415 A1 Dec. 6, 2012

Related U.S. Application Data

(60) Provisional application No. 61/491,782, filed on May 31, 2011.

(51) Int. Cl.
*A47L 9/14* (2006.01)

(52) U.S. Cl.
CPC ..... *A47L 9/1472* (2013.01); *A47L 9/1427* (2013.01); *A47L 9/1436* (2013.01); *Y10T 29/49826* (2015.01)

(58) Field of Classification Search
CPC ... A47L 9/1427; A47L 9/1436; A47L 9/1445; Y10T 29/49826
USPC ..... 15/347
IPC ..... A47L 9/14
See application file for complete search history.

(56) References Cited

U.S. PATENT DOCUMENTS

| | | | | |
|---|---|---|---|---|
| RE28,201 | E * | 10/1974 | Hughes | 55/367 |
| 4,364,757 | A | 12/1982 | Leonatti | |
| 5,057,131 | A | 10/1991 | Lackner | |
| 5,464,460 | A | 11/1995 | Bosses | |
| 5,544,385 | A | 8/1996 | Jailor | |
| 6,033,451 | A | 3/2000 | Fish | |
| 7,418,763 | B2 * | 9/2008 | Shaver et al. | 15/330 |
| 8,075,649 | B2 * | 12/2011 | Bosses | 55/347 |
| 2005/0098039 | A1 | 5/2005 | Davis | |
| 2007/0095031 | A1 | 5/2007 | Zahuranec | |
| 2010/0050372 | A1 | 3/2010 | Frackowiak | |

FOREIGN PATENT DOCUMENTS

| | | | |
|---|---|---|---|
| DE | 201 19 853 | U1 | 3/2002 |
| DE | 10 2008 021789 | A1 | 11/2009 |
| DE | 20 2010 016864 | U1 | 3/2011 |

OTHER PUBLICATIONS

International Search Report dated Aug. 24, 2012 issued in PCT/US2012/040225.

* cited by examiner

*Primary Examiner* — David Redding
(74) *Attorney, Agent, or Firm* — Global IP Counselors, LLP

(57) ABSTRACT

A vacuum bag attachment assembly for a vacuum cleaner includes a locking handle movably connected to the vacuum cleaner and movable between first and second positions. An opening in the handle receives a fitting of a vacuum bag. When the locking handle is in the first position, an outer shell of the vacuum cleaner is prevented from closing. When the locking handle is in the second position, the outer shell of the vacuum cleaner is closable.

32 Claims, 11 Drawing Sheets

VACUUM BAG ATTACHMENT ASSEMBLY

CROSS REFERENCE TO RELATED APPLICATION

This application claims the benefit under 35 U.S.C. §119(e) of U.S. Provisional Application Ser. No. 61/491,782, filed May 31, 2011, which is hereby incorporated by reference in its entirety.

FIELD OF THE INVENTION

The present invention relates to an attachment assembly for securing a vacuum bag to a vacuum cleaner. More particularly, the present invention relates to an attachment assembly having a locking handle movable from a first position to a second position to secure the vacuum bag to the vacuum cleaner. Still more particularly, the present invention relates to an attachment assembly that prevents a housing from closing when a locking handle is in the first position.

BACKGROUND OF THE INVENTION

Flow-through motor-style vacuum cleaners generally use an outer housing. The housing may be a partly porous bag because the air flow is being pushed into the vacuum bag. The housing is closeable, and typically uses a zipper or other suitable fastening means to access a vacuum bag (or filter bag) housed therein for removal and replacement of the vacuum bag. The vacuum bag is typically a disposable bag that collects dust and dirt during operation of the vacuum cleaner, and is disposed of when full and replaced with a new bag.

Because the vacuum bag is disposable, it must be economical to produce. The vacuum bag should also be sufficiently durable to permit it to be installed and removed without damage. It should also provide a connecting and sealing structure for connecting the vacuum bag to the dirt-laden discharge of the vacuum cleaner that is easily installed and provides a reliable seal.

A user of the vacuum cleaner may dispose of the vacuum bag, which is the primary filter, and forget to replace it with a new vacuum bag. The vacuum cleaner will still operate, but the collected dust and debris will be discharged into the housing. This results in unwanted dust and debris in the outer housing and can damage the housing as well as other parts of the vacuum cleaner. Additionally, the dust and debris may exit the housing and be returned to the environment from which it was collected. Accordingly, a need exists for a device that warns a user that a vacuum bag has not been properly installed.

Locking mechanisms for vacuum bags currently exist. However, indication of the absence of a vacuum bag is not made until just prior to attempting to operate the vacuum cleaner. Accordingly, a need exists for a visual indication visible from a distance that a vacuum bag has not been properly installed.

SUMMARY OF THE INVENTION

An attachment assembly in accordance with the present invention provides a visual indication to a user that a vacuum bag has not been properly installed. In accordance with exemplary embodiments, the housing is prevented from being closed when a locking handle of the attachment assembly is in the first, or up, position. The locking handle is moved to a second, or down, position to secure a vacuum bag to the vacuum cleaner, thereby allowing the housing to be closed.

The locking handle protrudes from the housing when in the first position, thereby preventing the housing from being closed and providing a visual indication to a user that a vacuum bag has not been properly installed. The user can then properly install a vacuum bag. During installation of the vacuum bag, the locking handle is moved from the first to the second position. In the second position, the locking handle no longer prevents the housing from being closed. The user can then close the housing and operate the vacuum cleaner.

Objects, advantages, and salient features of the invention will become apparent from the following detailed description, which, taken in conjunction with the annexed drawings, discloses an exemplary embodiment of the present invention.

As used in this application, the terms "front," "rear," "upper," "lower," "upwardly," "downwardly," and other orientational descriptors are intended to facilitate the description of the attachment assembly, and are not intended to limit the structure of the attachment assembly to any particular position or orientation.

BRIEF DESCRIPTION OF THE DRAWINGS

The above aspects and features of the present invention will be more apparent from the description for an exemplary embodiment of the present invention taken with reference to the accompanying drawing figures, in which.

Throughout the drawings, like reference numerals will be understood to refer to like parts, components and structures.

DETAILED DESCRIPTION OF AN EXEMPLARY EMBODIMENT

Figure 1:
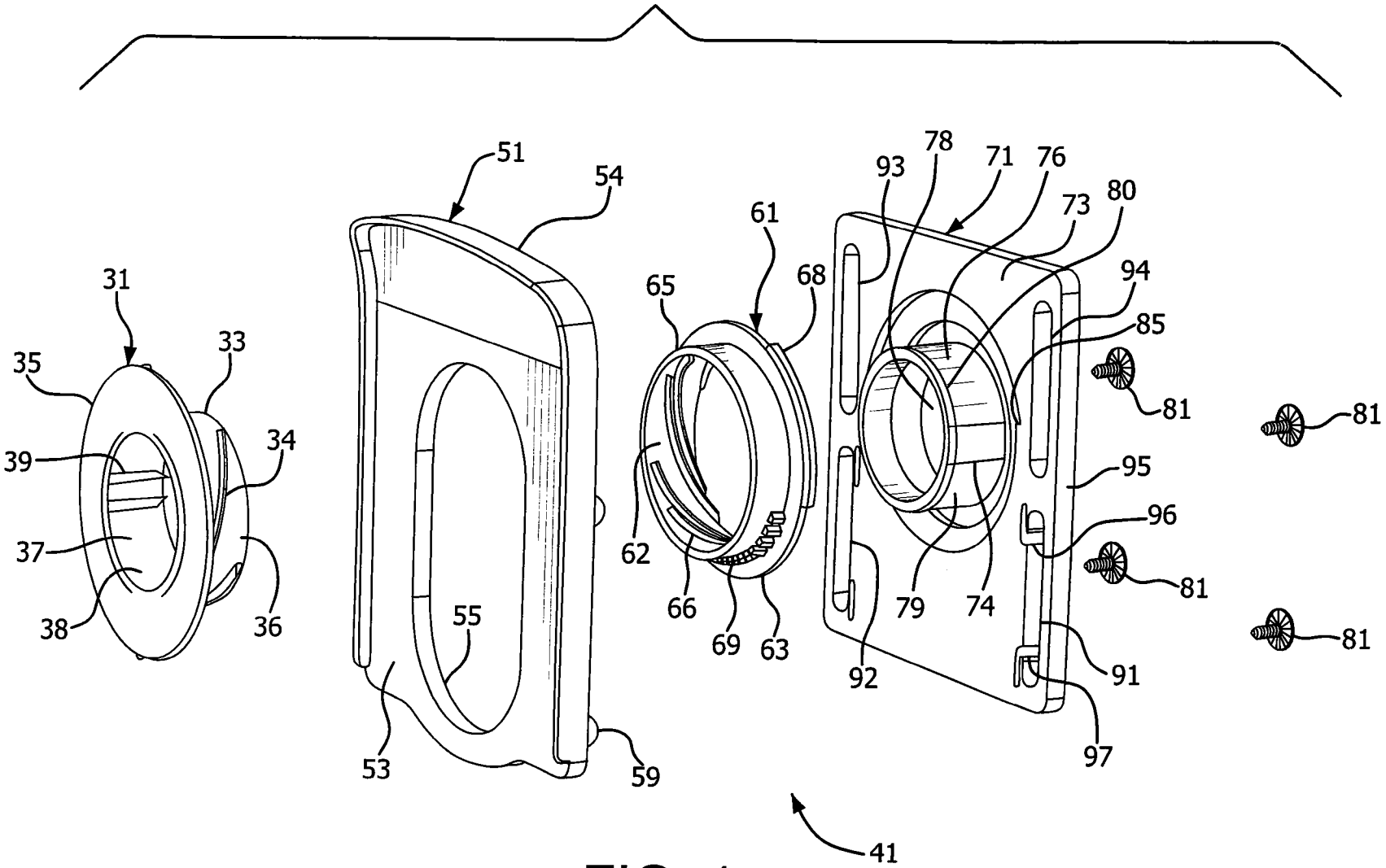
FIG. 1 is an exploded front perspective view of a vacuum bag attachment assembly in accordance with an exemplary embodiment of the present invention.

As shown in FIGS. 1-18, an attachment assembly 41 for a vacuum cleaner 11 includes a locking handle 51, a locking ring 61 and a mounting plate 71. The mounting plate 71 is fixedly secured to a backing plate 13 of the vacuum cleaner 11. The locking handle 51 is movably fixed to the mounting plate 71. The locking ring 61 is rotatably secured between the mounting plate 71 and the locking handle 51. A filter bag indicator and lockout safety system for a vacuum cleaner is disclosed in copending U.S. patent application Ser. No. 13/074,846, which is hereby incorporated by reference in its entirety.

Figure 15:
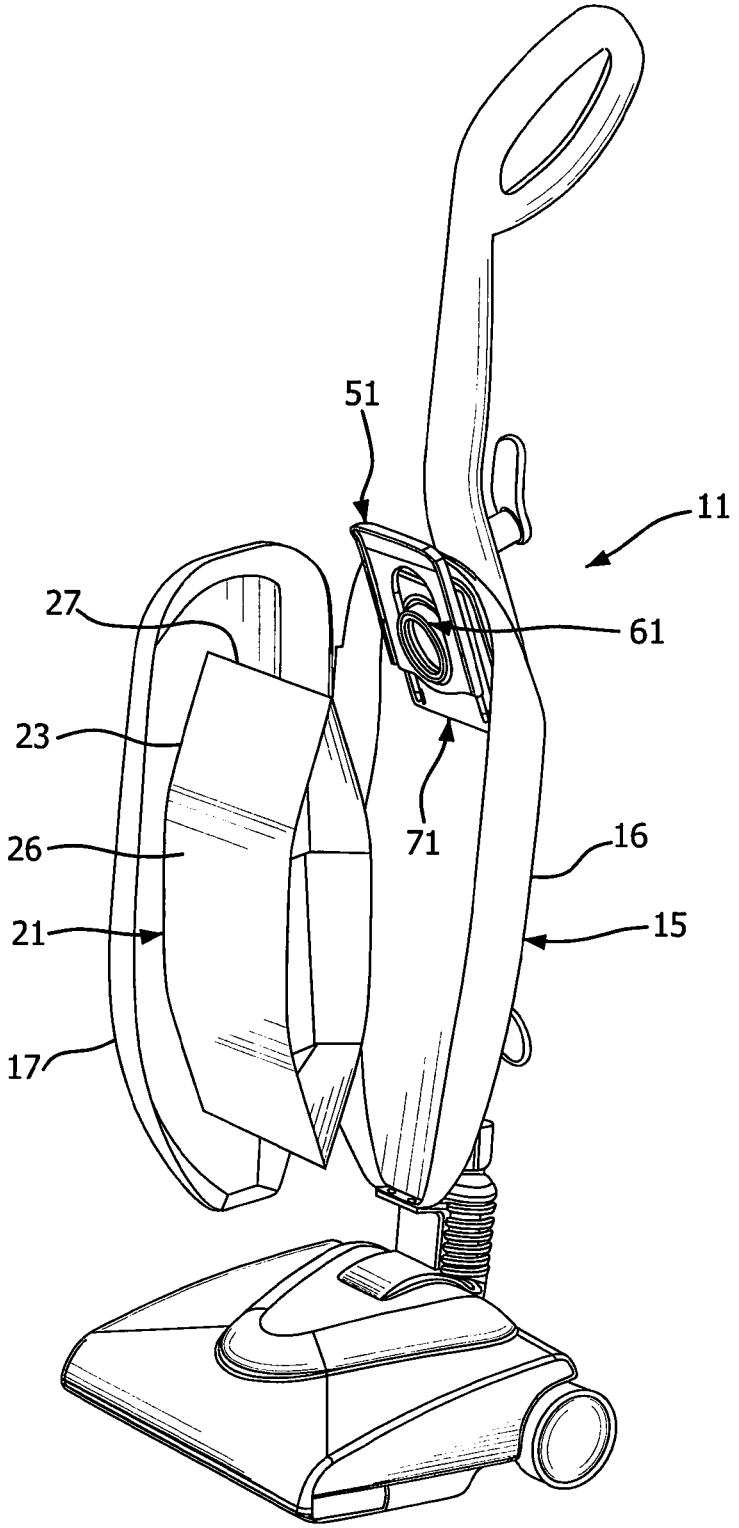
FIG. 15 is a front perspective view of the vacuum bag prior to engaging the attachment assembly of the vacuum cleaner of FIG. 14.
Figure 16:
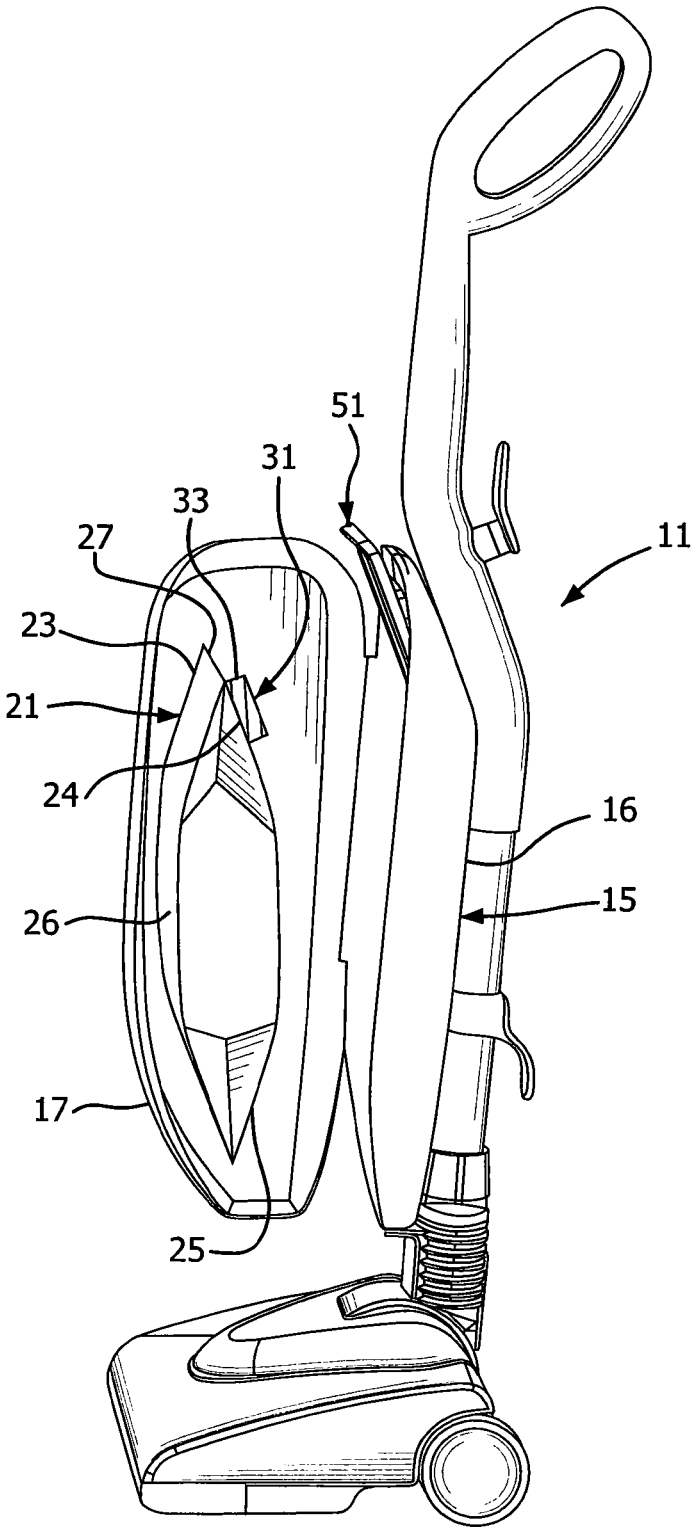
FIG. 16 is a side perspective view of the vacuum bag prior to engaging the attachment assembly of the vacuum cleaner of FIG. 15.
Figure 17:
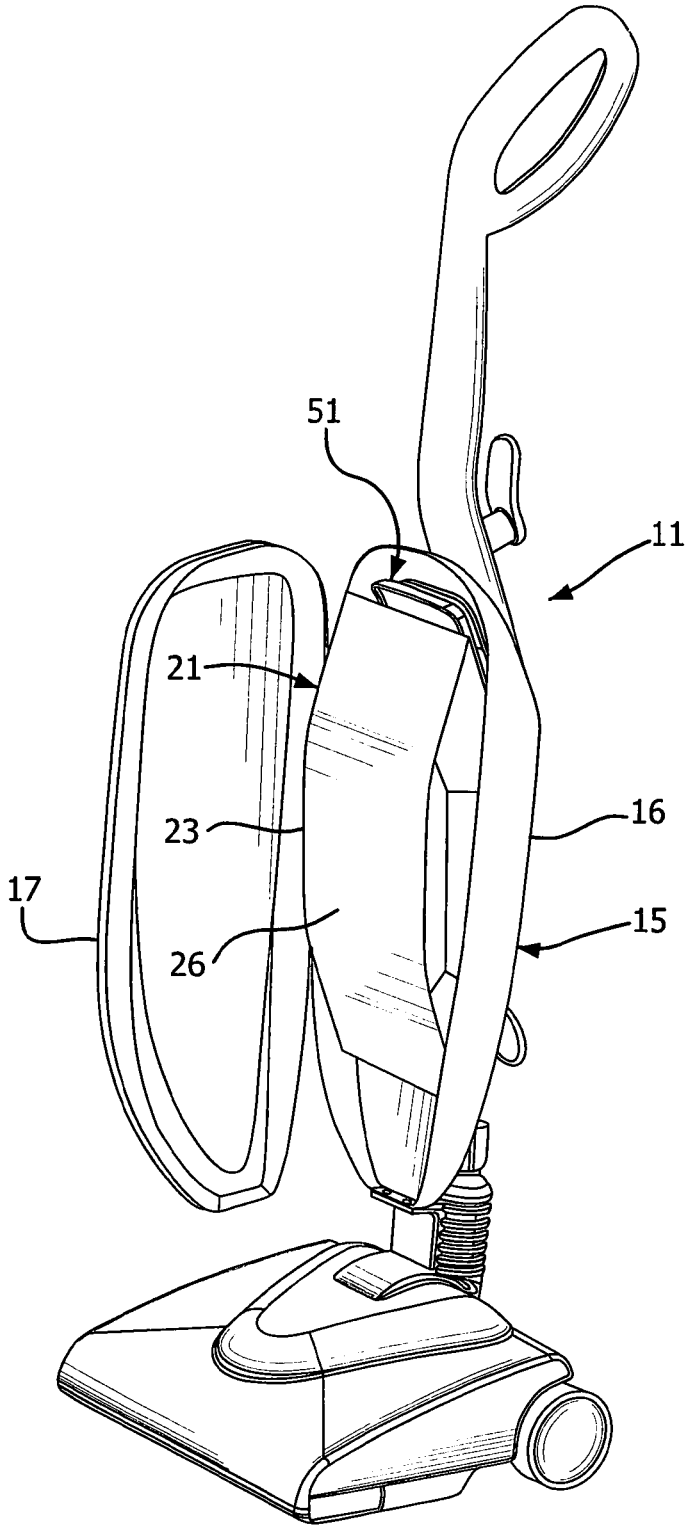
FIG. 17 is a front perspective view of the vacuum bag secured to the attachment assembly of the vacuum cleaner of FIG. 14.

A vacuum bag 21, such as that disclosed in copending U.S. patent application Ser. No. 12/628,840, which issued as U.S. Pat. No. 8,075,649 on Dec. 13, 2011 and is hereby incorporated by reference in its entirety, includes a container portion 23 having an opening 24 therein, as shown in FIGS. 15-17. Although shown as having a substantially rectangular shape, the vacuum bag 21 may have any suitable shape. The container portion 23 may be made of a flexible and porous material, such as paper, non-woven material, woven material, or a combination thereof. The container portion 23 has a front wall 25 and an opposite back wall 26. The container may also have a top wall and/or a bottom wall (not shown.) The opening 24 is formed in a wall of the container portion 23, such as in the front wall 25, for the intake of dust and debris from a vacuum cleaner. Preferably, the opening 24 is centered horizontally on the front wall 26 proximal an upper edge 27 of the container portion 23 to facilitate disposal in the vacuum cleaner housing. The opening 24 can be formed in any suitable wall of the container portion 23.

Figure 2:
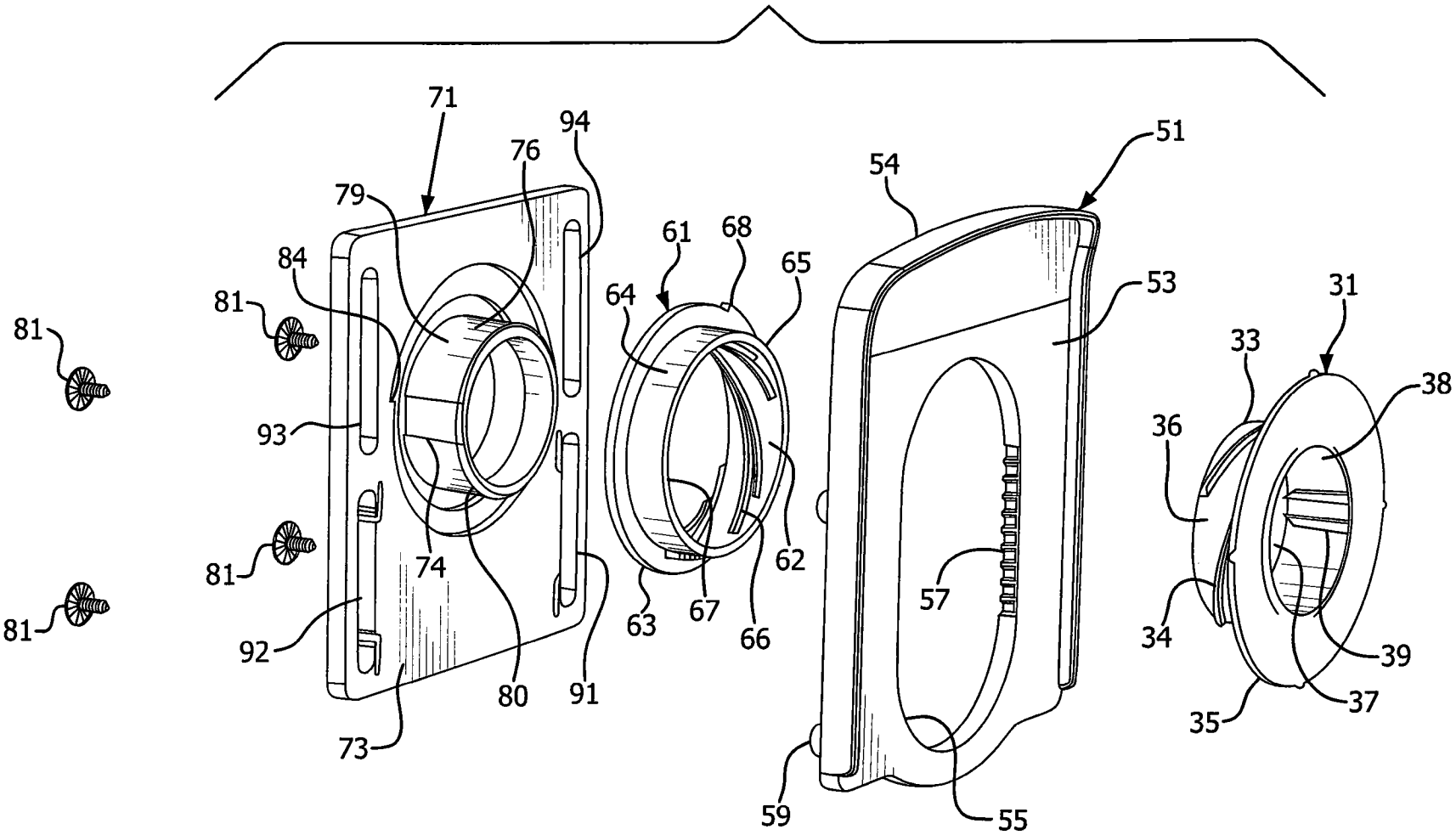
FIG. 2 is an exploded front perspective view of the vacuum bag attachment of FIG. 1 from a different angle.

A fitting, or collar, 31 is attached to the front wall 26 of the container portion, as shown in FIG. 16. The fitting 31 can be attached to the vacuum bag 21 in any suitable manner, such as with an adhesive. The fitting 31 includes a cylindrical portion 33 extending outwardly from a base 35. A fitting opening 37 extends completely through the cylindrical portion 33 and the base 35 of the fitting 31. The fitting 31 is secured to the vacuum bag 21 such that the fitting opening 37 is in communication with the opening 24 in the container portion 23. The fitting 31 is preferably made of a substantially rigid material, such as plastic, metal, cardboard, fiberboard or a combination thereof. Preferably, an outer surface 36 of the cylindrical portion 33 has a plurality of threads 34 to facilitate engaging the locking ring 61. An inner surface 38 of the cylindrical portion 33 has axially extending guide rails 39 to facilitate engagement with the mounting plate 71. Preferably, a pair of guide rails 39 are diametrically opposed on the inner surface 38 of the cylindrical portion 33 of the fitting 31, as shown in FIGS. 1 and 2. The engagement of the guide rails 39 with grooves 74 of a mounting plate projection 76 substantially prevent rotation of the vacuum bag 21 when being connected to and disconnected from the vacuum 11.

Figure 14:
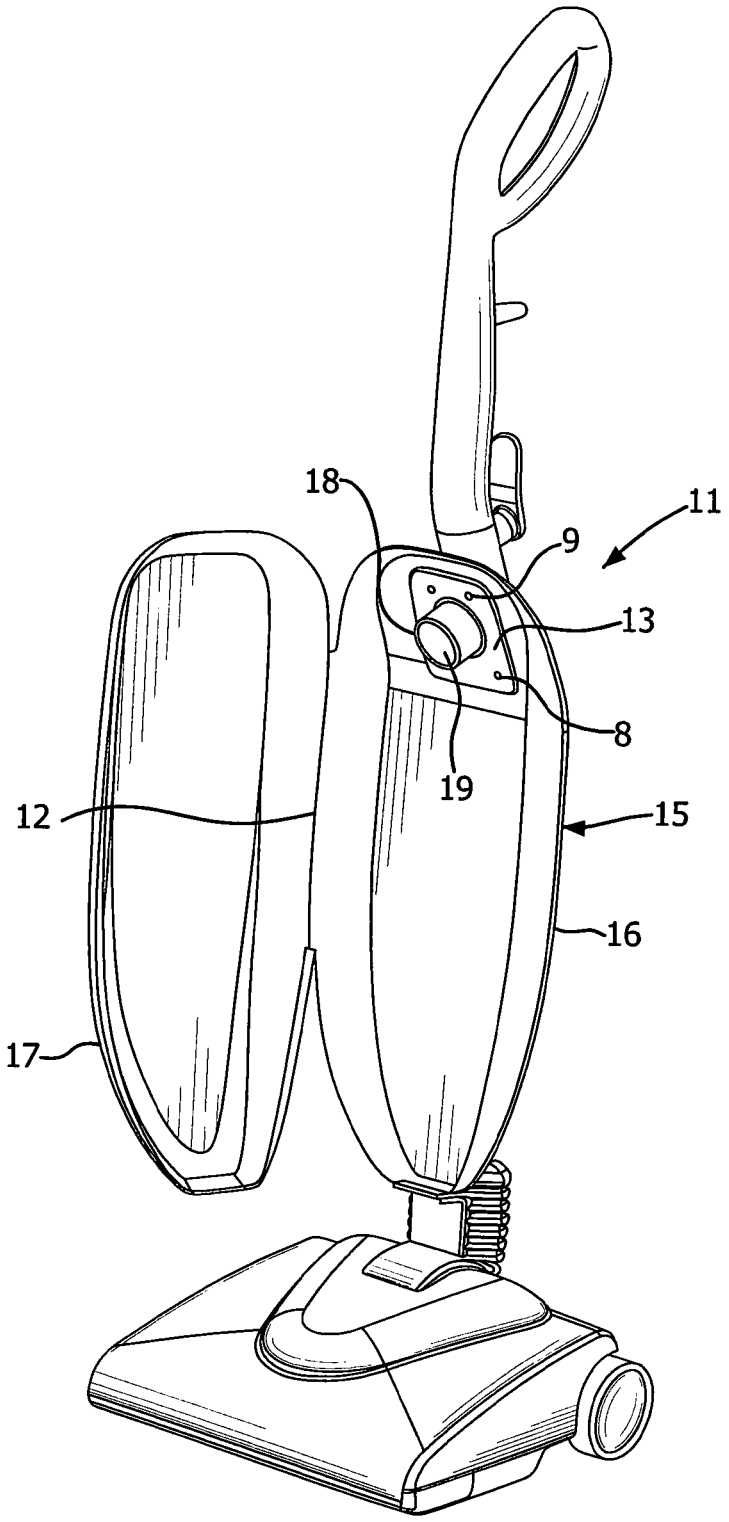
FIG. 14 is a front perspective view of a vacuum cleaner with a vacuum bag housing in the open position and without an attachment assembly connected thereto.

The vacuum cleaner 11 includes a housing 15 that receives the vacuum bag 21, as shown in FIGS. 15-17. The housing 15 is preferably porous to allow air passing through the vacuum bag 21 to pass through the housing. The housing 15 has a first housing part 16 and a second housing part 17. The first housing part 16 is secured by the backing plate 13 to the vacuum cleaner 11, as shown in FIG. 14. Fasteners 8 pass through a rear surface of the housing 15 and the backing plate 13 and are received by fastener openings 9 in the backing plate 13 to secure the backing plate 13 and housing 15 to the vacuum cleaner 11. A vacuum nozzle 18 passes through the backing plate 13 and has an opening 19 disposed within the housing 15. The second housing part 17 is movably connected to the first housing part 16, such as with a hinge 12. The remaining portion of the second housing part 17 is connected to the first housing part 16 in any suitable manner, such as with a zipper, to enclose the vacuum bag 21 therein. The second housing part 17 is openable with respect to the first housing part 16, to facilitate installing and removing the vacuum bag 21.

Figure 3:
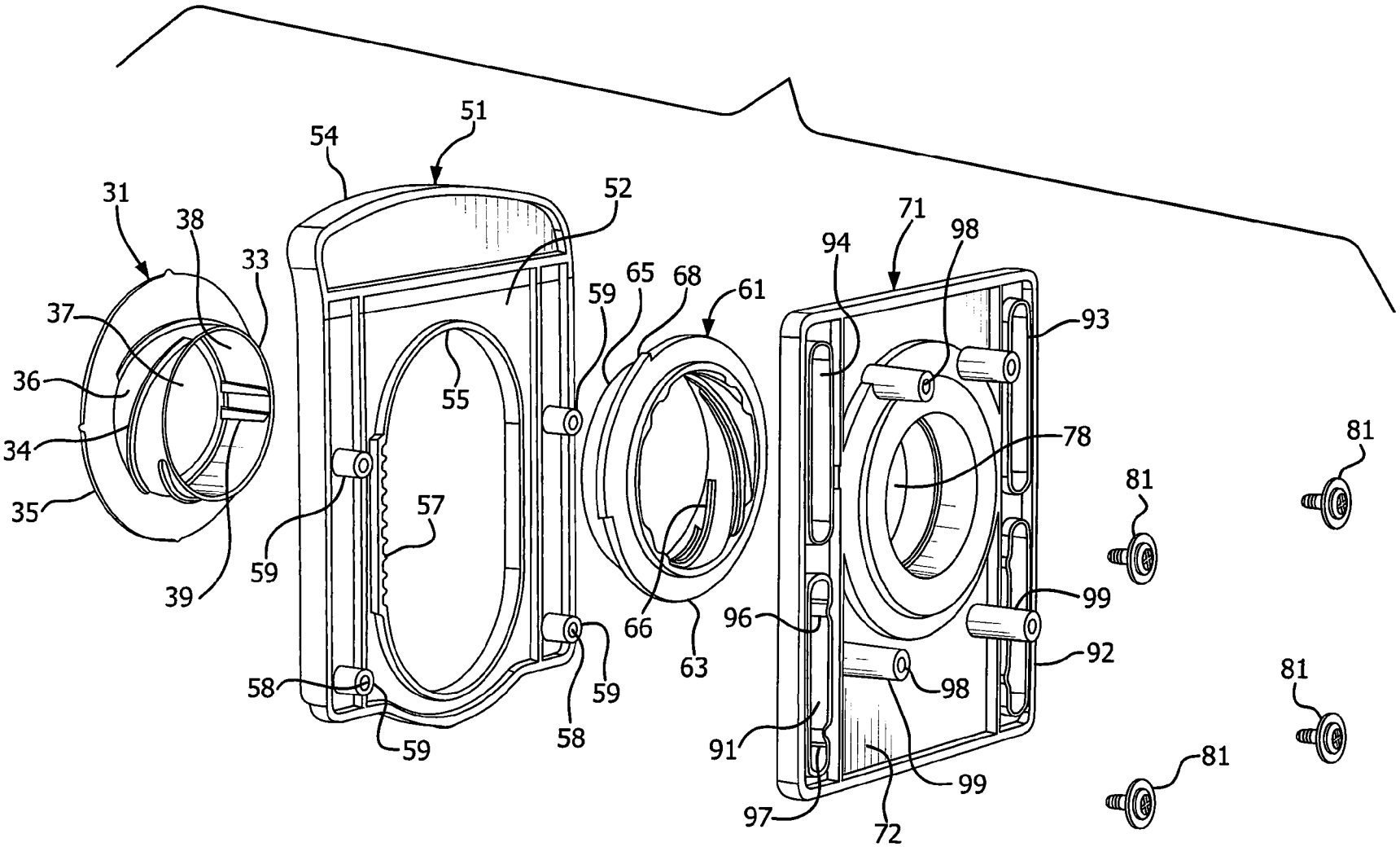
FIG. 3 is an exploded rear perspective view of the vacuum bag attachment assembly of FIG. 1.
Figures 4, 5, 6:
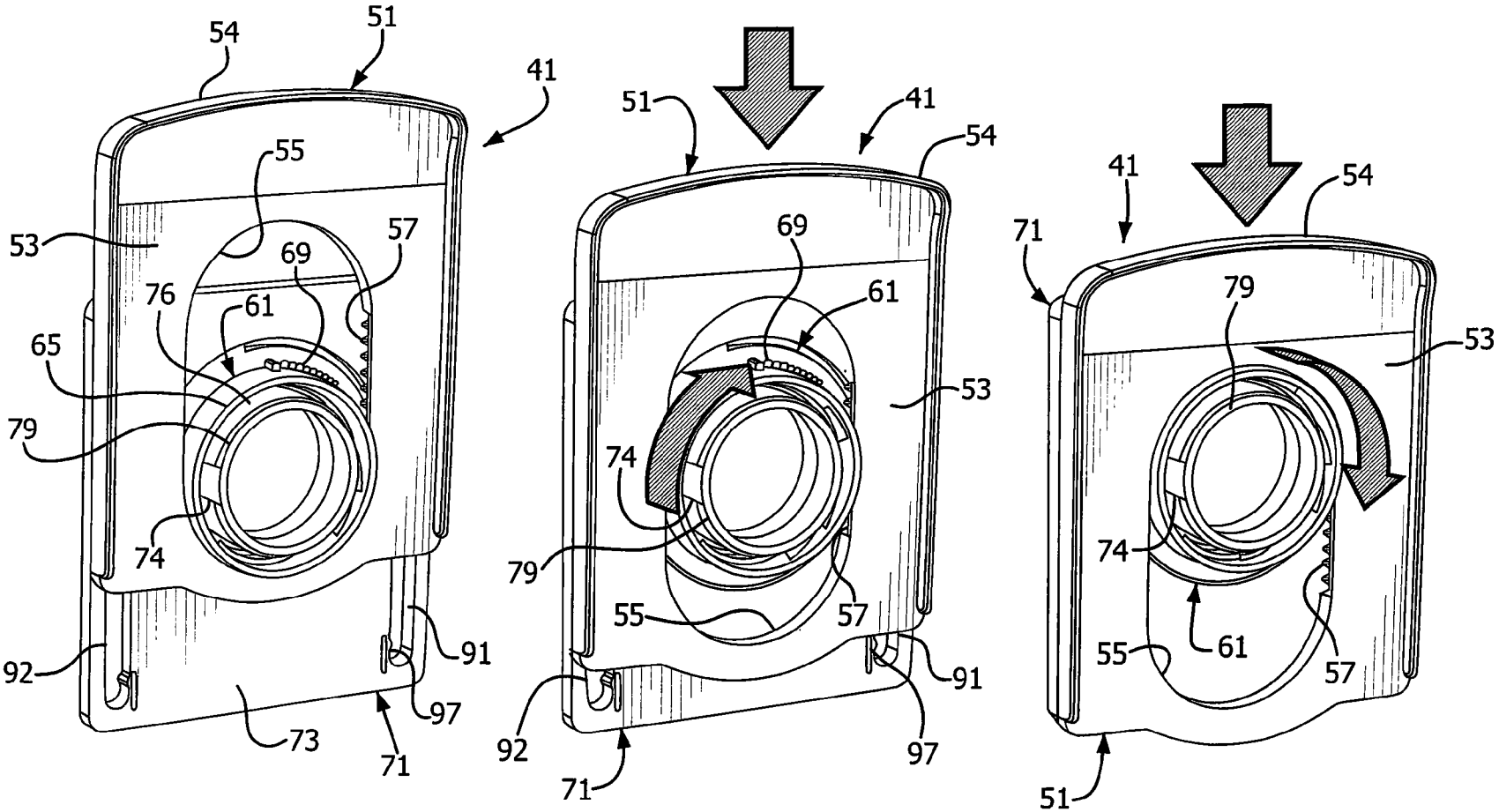
FIG. 4 is a front perspective view of the locking handle of the attachment assembly in a first position.
FIG. 5 is a front perspective view of the locking handle of the attachment assembly disposed between the first position and a second position.
FIG. 6 is a front perspective view of the locking handle of the attachment assembly in a second position.

The locking handle 51 has an inner surface 52 facing the mounting plate 71 and an outer surface 53 facing the vacuum bag fitting 31, as shown in FIGS. 1-3. An opening 55 extends through the locking handle 51 from the inner surface 52 to the outer surface 53. A handle 54 extends upwardly and away from the opening 55 to facilitate grasping by a user. A plurality of teeth 57 extend along a portion of the opening 55. A plurality of projections 59 extend outwardly from the inner surface 52 of the locking handle 59. Preferably, as shown in FIG. 3, the locking handle 51 has four projections 59. An opening 58 in each projection 59 receives a fastener 81 to movably connect the locking handle 51 to the mounting plate 71. The openings 58 preferably do not extend to the outer surface 53 of the locking handle 51, as shown in FIGS. 4-6.

The locking ring 61 has a base 63 with a cylindrical portion 65 extending outwardly therefrom, as shown in FIGS. 1-3. The cylindrical portion 65 has an inner surface 62 and an outer surface 64. An opening 67 extends completely through the cylindrical portion 65 and the base 63 of the locking ring 61. The inner surface 62 of the cylindrical portion 65 of the locking ring 61 preferably has a plurality of threads 66 to facilitate engagement with the threads 34 disposed on the outer surface 36 of the cylindrical portion 33 of the vacuum bag fitting 31. A plurality of teeth 69 are disposed on the outer surface 64 of the locking ring 61 to facilitate engagement with the teeth 57 of the locking handle 51. A tab 68 extends outwardly from an edge of the base 63, as shown in FIGS. 1-3.

The mounting plate 71 has an inner surface 72 facing away from the locking handle 51 and an outer surface 73 facing the locking handle 51, as shown in FIGS. 1-3. A nozzle or projection 79 extends outwardly from the outer surface 73 of the mounting plate 71. An opening 78 in the projection 79 extends completely through the mounting plate 71 from the inner surface 72 through the end of the projection 79. A sealing member 80 is disposed at a free end of the projection. The sealing member 80 is adapted to engage an inner surface 38 of the cylindrical portion 33 of the vacuum bag fitting 31 to create a seal between the vacuum bag 21 and the vacuum cleaner 11. The sealing member 80 can be any suitable member, such as an O-ring or gasket. Alternatively, the sealing member 80 can be overmolded on the projection 79. Alternatively, the sealing member 80 can be formed on the inner surface 38 of the portion 33 of the vacuum bag fitting 31.

A plurality of slots 91-94 extend substantially parallel to a side wall 95 of the mounting plate 71, and receive the fasteners 81 to movably connect the locking handle 51 to the mounting plate 71. Preferably, each of the lower slots 91 and 92 has upper and lower detents 96 and 97, respectively. A plurality of projections 99 extend outwardly from an inner surface 72 of the mounting plate 71. Preferably, as shown in FIG. 3, the mounting plate has four projections 59. Each of the plurality of projections 99 has an opening 98 to receive the fasteners 8 that secure the backing plate 13 to the vacuum cleaner 11. The openings 98 in the projections 99 preferably do not extend to the outer surface 73 of the mounting plate 71. The mounting plate 71 has first and second stops 84 and 85, as shown in FIGS. 1 and 2, disposed outwardly of the projection 79 to limit rotationally movement of the locking ring 61 on the projection 79.

The locking handle 51, locking ring 61 and mounting plate 71 are made of any suitable material, such as, but not limited to, plastic, such as ABS, polycarbonate and PC/ABS plastic.

Assembly and Operation

The attachment assembly 41 is pre-assembled prior to being connected to the vacuum cleaner 11, as shown in FIGS. 4-6. The locking ring 61 is disposed on the projection 79 of the mounting plate 71. An outer surface 76 of the projection 79 is spaced from an inner surface 62 of the locking ring 61 to receive the vacuum bag fitting 31 therebetween. The locking handle 51 is disposed on the mounting plate 71 such that each of the projections 59 is received in one of the slots 91-94. The fasteners 81 are received in the openings 58 of the locking handle projections 59 such that the locking handle 51 is secured to the mounting plate 71 with the locking ring 61 secured therebetween. The locking handle 51 is movably connected to the mounting plate 71 so that the projections 59 move along the length of the slots 91-94. The heads of the fasteners are larger than the width of the slots 91-94 to prevent the locking handle 51 from being separated from the mounting plate 71.

As shown in FIG. 15, the attachment assembly 41 is connected to the backing plate 13 of the vacuum cleaner 11. The fasteners 8 are received in the openings 98 of the mounting plate projections 99 to secure the attachment assembly 41 to the vacuum cleaner 11.

Figures 7, 8, 9, 10:
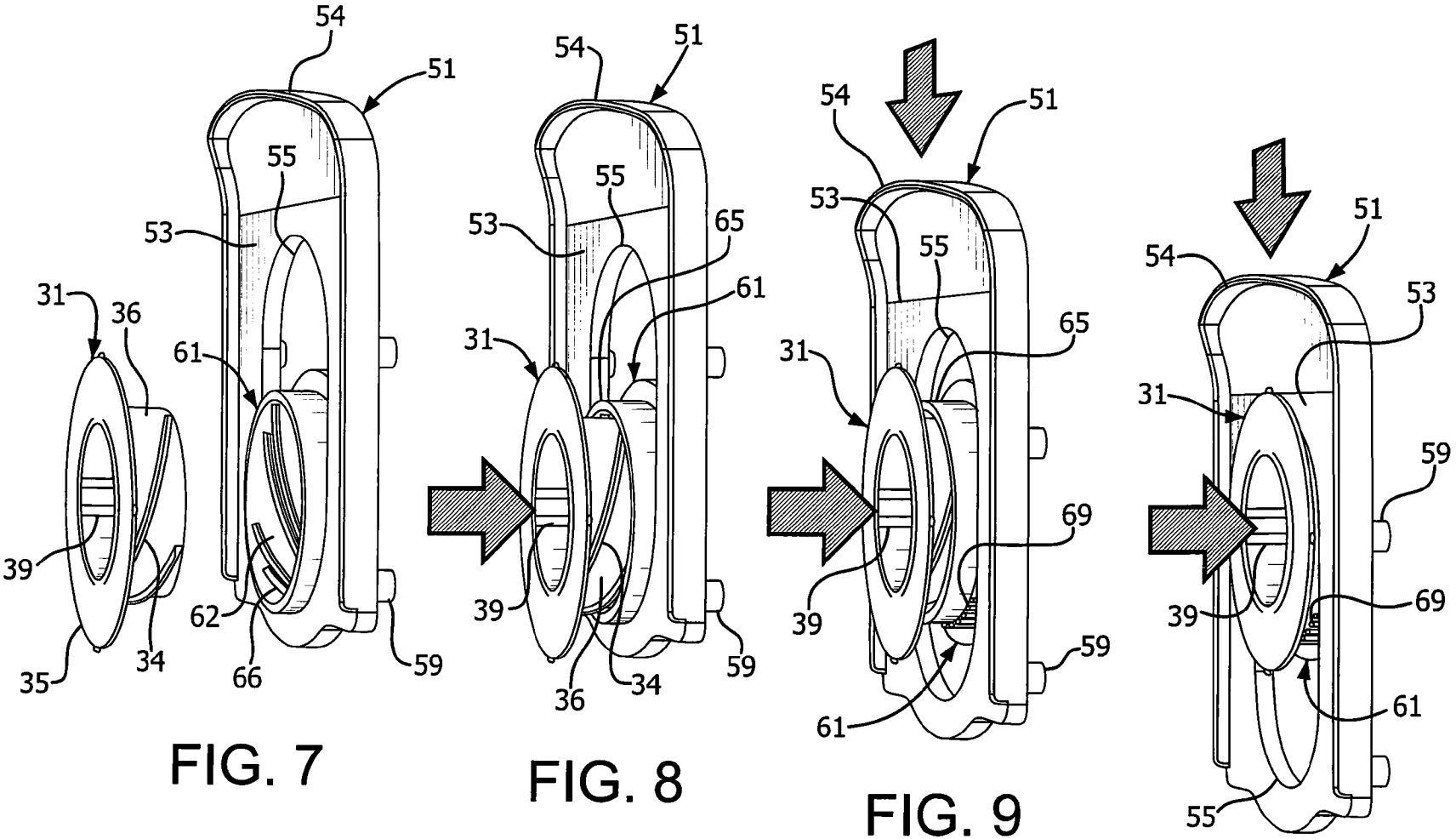
FIG. 7 is a perspective view of a bag collar prior to engaging the attachment assembly of a vacuum cleaner with the locking handle in the first position.
FIG. 8 is a perspective view of the bag collar engaging a locking ring of the attachment assembly of FIG. 7 with the locking handle in the first position.
FIG. 9 is a perspective view of the bag collar engaging the locking ring of the attachment assembly of FIG. 8 with the locking handle disposed between the first and second positions.
FIG. 10 is a perspective view of the locking handle moved to the second position to secure the bag collar to the attachment assembly of FIG. 9.
Figure 13:
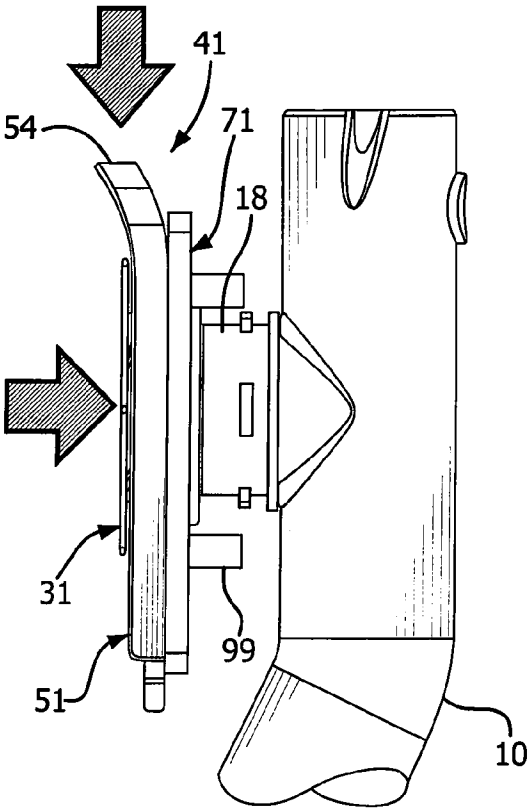
FIG. 13 is an elevational view of the locking handle of the attachment assembly of FIG. 11 moved to the second position to secure the bag collar to the attachment assembly.
Figure 12:
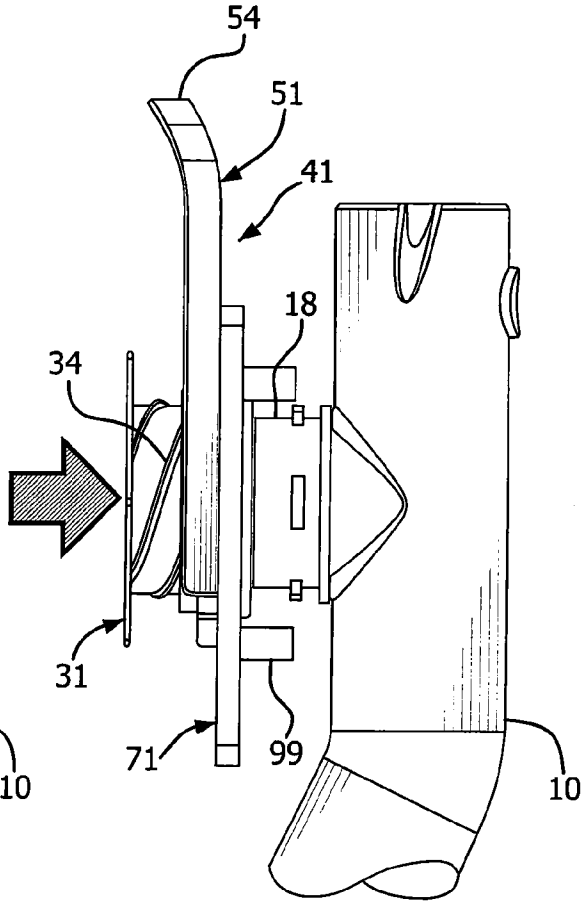
FIG. 12 is an elevational view of the bag collar engaging the locking ring of the attachment assembly of FIG. 11 with the locking handle in the first position.
Figure 11:
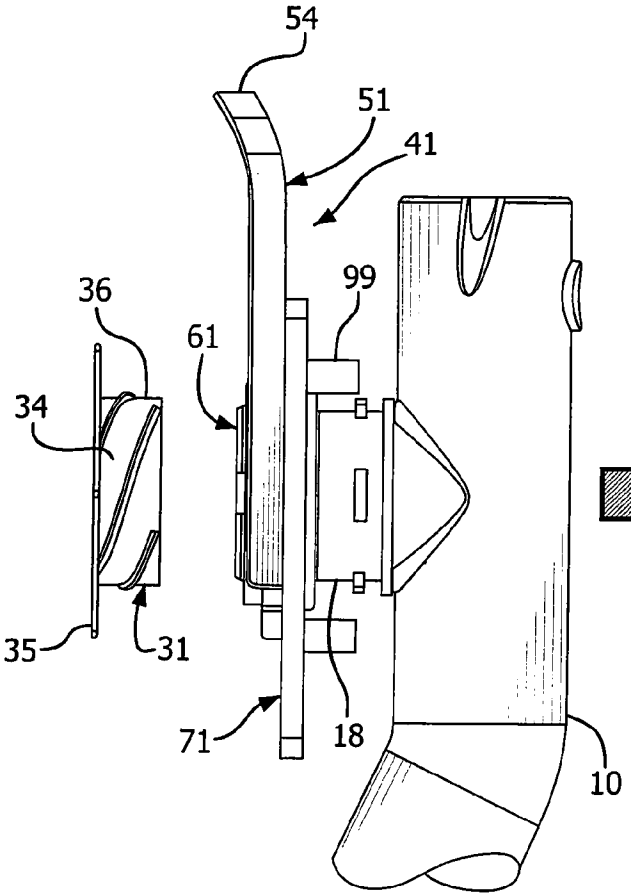
FIG. 11 is an elevational view of the bag collar approaching the attachment assembly of the vacuum cleaner with the locking handle in the first position.

To connect a vacuum bag 21 to the vacuum cleaner 11, as shown in FIGS. 7, 15 and 16, the second housing part 17 is opened with respect to the first housing part 16. The vacuum bag fitting 31 is connected to the attachment assembly 41 by inserting the cylindrical portion 33 of the fitting 31 between the outer surface 76 of the mounting plate projection 79 and the inner surface 62 of the cylindrical portion 65 of the locking ring 51. The guide rings 39 of the vacuum bag fitting 31 engage grooves 74 on the outer surface 76 of the mounting plate projection 79 to facilitate movement of the bag fitting 31 as it is threadably connected to the locking ring 61.

When the vacuum bag fitting 31 is initially connected to the attachment assembly 41, as shown in FIG. 8, the locking handle 51 is in the first, or upper, position. The locking handle projections 59 are received in the upper ends of the slots 91-94, such that the upper detents 96 prevent accidental downward movement of the projections 59 through the lower slots 91 and 92. The locking handle 51 is then moved to the second, or lower, position, as shown in FIG. 10, by pushing the locking handle 51 downwardly. Pushing the locking handle 51 downwardly overcomes the force exerted by the upper detents 96 on the projections 59, thereby allowing the projections 59 to move downwardly in the slots 91-94 as shown in FIG. 9.

The downward movement of the locking handle 51 to the second position causes the locking ring 61 to rotate due to the engagement between the locking handle teeth 57 and the locking ring teeth 69, as shown in FIGS. 5 and 6. The locking ring 61 is disposed on the mounting plate projection 79 such that lateral movement of the locking ring 61 is substantially prevented, i.e., the locking ring is limited to only rotational movement. The rotation of the locking ring 61 results, in turn, in inward axial movement of the vacuum bag fitting 31, thereby securing the vacuum bag 21 to the vacuum cleaner 11, as shown in FIG. 17. The guide rings 39 of the vacuum bag fitting 31 are received in the grooves 74 of the mounting plate projection 79, thereby substantially preventing rotation of the vacuum bag fitting 31, and thus the vacuum bag 11, during connection and disconnection. A substantially air tight seal is created between the vacuum bag fitting 31 and the vacuum nozzle 18. The sealing member 80 on the projection 79 engages the inner surface 38 of the vacuum bag fitting 31 to effectuate the seal between the vacuum bag 21 and the vacuum cleaner 11. The second housing part 17 can then be connected to the first housing part 16 to close the housing 15 so the vacuum 11 can be operated.

The locking ring 61 is initially in a position such that the tab 68 engages the first stop 84 (FIG. 2) of the mounting plate 71. Moving the locking handle 51 from the first position to the second position rotates the locking ring 61 on the mounting plate projection 79. The locking ring tab 68 abuts the second stop 85 (FIG. 1) when the locking handle 51 is in the second position to further facilitate limiting rotation of the locking ring 61.

To remove the vacuum bag 21 from the vacuum cleaner 11, the above-described process is performed in reverse. The locking handle 51 is lifted upwardly towards the first position, thereby causing rotation of the locking ring 61 away from the vacuum bag fitting 31. When the locking handle 51 returns to the first position, the vacuum bag 21 can be removed from the vacuum cleaner 11.

Figure 18:
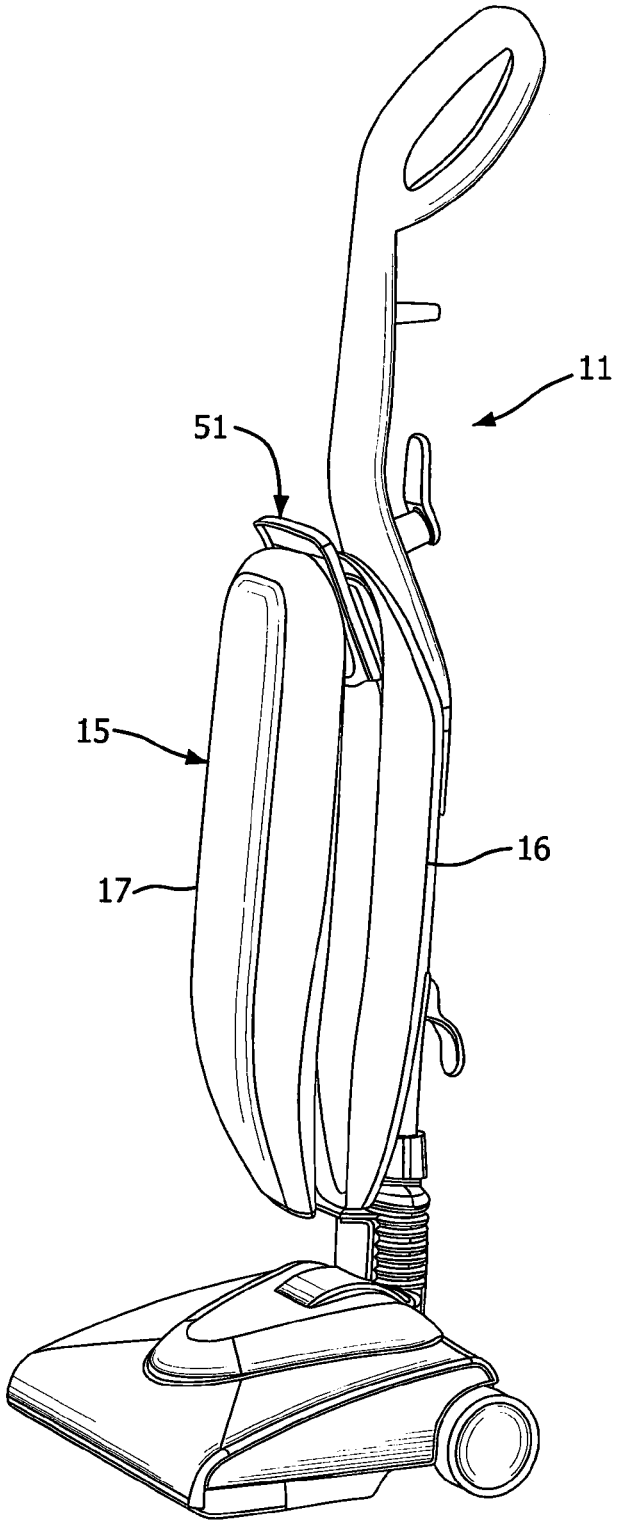
FIG. 18 is a perspective view of the vacuum cleaner of FIG. 14 with the locking handle in the first position.

With the locking handle 51 in the first position, as shown in FIG. 18, the housing 15 cannot be closed because the locking handle 51 prevents the second housing part 17 from being connected to the first housing part 16. This provides a visual indication to the user, which is visible from a distance, that a vacuum bag 21 has not been properly connected to the vacuum cleaner and that the vacuum cleaner should not be operated. Upon properly installing a vacuum bag 21, as described above, the locking handle 51 is moved to the second position such that the second housing part 17 can be connected to the first housing part to close the housing 15.

While an advantageous embodiment has been chosen to illustrate the invention, it will be understood by those skilled in the art that various changes and modifications may be made therein without departing from the scope of the invention.

The foregoing embodiment and advantages are merely exemplary and are not to be construed as limiting the scope of the present invention. The description of an exemplary embodiment of the present invention is intended to be illustrative, and not to limit the scope of the present invention. Various modifications, alternatives and variations will be apparent to those of ordinary skill in the art, and are intended to fall within the scope of the invention as defined in the appended claims and their equivalents.

What is claimed is:

1. A vacuum bag attachment assembly for a vacuum cleaner, comprising:

a locking handle movably connected to an outer shell of the vacuum cleaner and movable between first and second positions; and an opening formed in said locking handle for receiving a fitting of a vacuum bag, when said locking handle is in said first position a second part of the outer shell of the vacuum cleaner is prevented from mating with a first part of the outer shell and when said locking handle is in said second position the second part of the outer shell of the vacuum cleaner is mateable with the first part of the outer shell.

2. The vacuum bag attachment assembly according to claim 1, wherein a locking ring is rotatably connected to said locking handle such that movement of said locking handle between said first and second positions rotates said locking ring to move the vacuum bag fitting axially toward said locking ring.

3. The vacuum bag attachment assembly according to claim 2, wherein a portion of said opening has a first plurality of teeth to engage a second plurality of teeth of said locking ring.

4. The vacuum bag attachment assembly according to claim 2, wherein said locking ring is threaded to threadably engage the vacuum bag fitting.

5. The vacuum bag attachment assembly according to claim 2, wherein said locking ring is laterally fixed relative to said locking handle to substantially prevent lateral movement of said locking ring with movement of said locking handle between said first and second positions.

6. The vacuum bag attachment assembly according to claim 2, wherein a mounting plate is connected to the vacuum cleaner and has a plurality of slots to movably receive said locking handle.

7. The vacuum bag attachment assembly according to claim 6, wherein said mounting plate has an outwardly extending projection to rotatably receive said locking ring.

8. The vacuum bag attachment assembly according to claim 7, wherein a groove on an outer surface of said mounting plate projection receives corresponding guide rails on the vacuum bag fitting to facilitate connecting the vacuum bag to said attachment assembly.

9. A vacuum cleaner, comprising:

a vacuum cleaner body; and an attachment assembly connected to said vacuum cleaner body, said attachment assembly including a mounting plate connected to said vacuum cleaner body;

a locking ring rotatably connected to said mounting plate; and a locking handle movably connected to said mounting plate and movable between first and second positions such that movement between said first and second positions rotates said locking ring.

10. The vacuum cleaner according to claim 9, wherein said vacuum cleaner body includes an outer shell having a first part and a second part openable with respect to said first part.

11. The vacuum cleaner according to claim 10, wherein when said locking handle is in said first position said second part of said outer shell is prevented from closing and when said locking handle is in said second position said second part of said outer shell is closable with respect to said first part of said outer shell.

12. The vacuum cleaner according to claim 9, wherein a portion of an opening of said locking handle has a first plurality of teeth to engage a second plurality of teeth of said locking ring to facilitate rotation of said locking ring when said locking handle moves between said first and second positions.

13. The vacuum cleaner according to claim 9, wherein said locking handle has a plurality of projections; and said mounting plate has a plurality of slots to receive said plurality of projections to facilitate movement of said locking handle between said first and second positions.

14. The vacuum cleaner according to claim 9, wherein first and second detents are formed at opposite ends of at least one of said plurality of slots to substantially prevent accidental movement of said locking handle when in said first or second position.

15. The vacuum cleaner according to claim 9, wherein said locking ring is threaded to receive a threaded fitting of a vacuum bag.

16. The vacuum cleaner according to claim 9, wherein said mounting plate has an outwardly extending projection to rotatably receive said locking ring, and a groove on an outer surface of said mounting plate projection receives corresponding guide rails on a fitting of a vacuum bag fitting to facilitate connecting the vacuum bag to said attachment assembly.

17. The vacuum cleaner according to claim 16, wherein the vacuum bag fitting is receivable between said outer surface of said mounting plate projection and an inner surface of said locking ring.

18. The vacuum cleaner according to claim 9, wherein said attachment assembly is directly connected to said vacuum cleaner body.

19. A method of connecting a vacuum bag to a vacuum cleaner, comprising the steps of connecting a fitting of a vacuum bag with an attachment assembly of a vacuum cleaner;

rotating a locking handle of the attachment assembly concentrically to the fitting of the vacuum bag from a first position to a second position to secure the vacuum bag to the vacuum cleaner; and enclosing the vacuum bag in a portion of the vacuum cleaner.

20. The method of connecting a vacuum bag to a vacuum cleaner according to claim 19, wherein the vacuum bag is enclosed within an outer shell of the vacuum cleaner.

21. The method of connecting a vacuum bag to a vacuum cleaner according to claim 20, wherein the outer shell is prevented from closing when the locking handle is in the first position.

22. The method of connecting a vacuum bag to a vacuum cleaner according to claim 19, wherein moving the locking handle from the first position to the second position rotates a locking ring of the attachment assembly threadably engaged with the vacuum bag fitting thereby securing a seal between the vacuum bag to the vacuum cleaner.

23. The method of connecting a vacuum bag to a vacuum cleaner according to claim 19, wherein the vacuum bag is prevented from rotating when connecting the vacuum bag fitting to the attachment assembly.

24. A vacuum cleaner, comprising:

a vacuum cleaner body;

a vacuum bag having a threaded fitting extending outwardly therefrom;

an attachment assembly connected to said vacuum cleaner body, said attachment assembly comprising a mounting plate connected to said vacuum cleaner body;

a threaded locking ring rotatably connected to said mounting plate and adapted to threadably engage said vacuum bag fitting; and a locking handle movably connected to said mounting plate and movable between first and second positions such that movement between said first and second positions rotates said locking ring.

25. The vacuum cleaner according to claim 24, wherein said vacuum bag fitting has an inner surface and an outer surface, said threads being disposed on said outer surface.

26. The vacuum cleaner according to claim 25, wherein at least one guide rail is disposed on said inner surface of said vacuum bag fitting.

27. The vacuum cleaner according to claim 26, wherein said mounting plate has an outwardly extending projection to rotatably receive said locking ring, and a groove on an outer surface of said mounting plate projection adapted to receive said at least one guide rail on said vacuum bag fitting thereby to substantially prevent rotation of said vacuum bag when said vacuum bag threaded fitting engages said attachment assembly.

28. The vacuum cleaner according to claim 24, wherein said attachment assembly is directly connected to said vacuum cleaner body.

29. A vacuum bag, comprising:

a substantially porous body;

at least one inlet in said body;

a fitting extending outwardly from said body and in communication with said inlet, said fitting having an inner and an outer surface and threads being disposed on said outer surface of said fitting; and at least one guide rail disposed on said inner surface of said threaded fitting adapted to engage a vacuum cleaner.

30. The vacuum bag according to claim 29, wherein said fitting has a base and a cylindrical wall extending outwardly therefrom.

31. The vacuum bag according to claim 30, wherein a pair of guide rails extend from a free end of said cylindrical wall to said base.

32. The vacuum bag according to claim 31, wherein said pair of guide rails are substantially diametrically opposed.

* * * * *